US008403685B2

(12) United States Patent
Halmuschi et al.

(10) Patent No.: US 8,403,685 B2
(45) Date of Patent: Mar. 26, 2013

(54) ELECTRICAL SIGNAL CONNECTOR

(75) Inventors: Nader Halmuschi, Nanjing (CN); Li Liu, Nanjing (CN); Sheng Hai Xu, Nanjing (CN)

(73) Assignee: Siemens Aktiengesellschaft, München (DE)

( * ) Notice: Subject to any disclaimer, the term of this patent is extended or adjusted under 35 U.S.C. 154(b) by 614 days.

(21) Appl. No.: 12/087,905

(22) PCT Filed: Jan. 16, 2007

(86) PCT No.: PCT/EP2007/050377

§ 371 (c)(1), (2), (4) Date: Jun. 27, 2011

(87) PCT Pub. No.: WO2007/082879

PCT Pub. Date: Jul. 26, 2007

(65) Prior Publication Data

US 2011/0250784 A1 Oct. 13, 2011

(30) Foreign Application Priority Data

Jan. 20, 2006 (CN) ..... 2006 1 0002188

(51) Int. Cl.
*H01R 13/648* (2006.01)

(52) U.S. Cl. ..... 439/98

(58) Field of Classification Search ..... 439/607.41–607.52, 579, 98, 99
See application file for complete search history.

(56) References Cited

U.S. PATENT DOCUMENTS 4,790,765 A * 12/1988 Ehrenfels et al. ..... 439/96
5,466,175 A 11/1995 Onoda
5,823,825 A 10/1998 Murphy
5,964,620 A 10/1999 Takahashi et al.

* cited by examiner

*Primary Examiner* — Ross Gushi

(57) ABSTRACT

An electrical signal connector which is interposed between an electronic device and an electrical signal cable, which is used for an electrical signal which is output from the electronic device or an electrical signal which is input into the electronic device, and which has an electrical signal cut-in terminal, an electrically conductive plate and at least one metal cable clamp. At the time of installation of the electrical signal connector, electric wire connectors in the electrical signal cable which communicate with the exterior are taken forwards along one surface of the conductive plate and extended together with conductive plate projecting terminals into accommodating electrical signal cut-in terminal ports of the electronic device, and, at the same time, the electrical signal cable and conductive plate are closely connected via the metal cable clamp, so fixing the electrical signal cable and conductive plate together, and ensuring that the cable connectors do not suffer damage. The electrical signal connector of the invention has a simple structure, and is easy to replace, and, at the same time, the cost of its manufacture is comparatively low.

7 Claims, 4 Drawing Sheets

ELECTRICAL SIGNAL CONNECTOR

CROSS REFERENCE TO RELATED APPLICATIONS

This application is the US National Stage of International Application No. PCT/EP2007/050377, filed Jan. 16, 2007 and claims the benefit thereof. The International Application claims the benefits of Chinese application No. 200610002188.9 CN filed Jan. 20, 2006, both of the applications are incorporated by reference herein in their entirety.

FIELD OF INVENTION

The present invention relates to an electrical signal connector and, more particularly, it relates to an electrical signal connector which effects turn-on of an electrical signal device and is connected to at least one external-connection electrical signal cable.

BACKGROUND OF INVENTION

In existing technology, an electrical signal connector is commonly used to input electrical signals into an electronic device or to output them from the electronic device to the exterior.

One type of electrical signal connector in existing technology has a cuboid box structure provided with a plastic casing, and, when this cuboid electrical signal connector is set on a horizontal surface, it has one top surface, one bottom surface and four side surfaces. Sets of cut-in ports are respectively provided in two adjacent sides. One of these sets of cut-in ports is connected to an electronic device and serves to lead signals into this electronic device or to output signals from the electronic device to the exterior. The various ports of this set of ports are connected to the other set of ports via a flexible circuit board. This other set of ports is connected to at least one electrical signal cable which is used to transfer output signals. This electrical signal connector can broadly be divided into two portions, which are a top portion and a bottom portion going from a horizontal plane between the top surface and the bottom surface, and, along with this, there is a pivot shaft in the centre of one side surface, and the top portion and bottom portion of the electrical signal connector can be rotated turning about this pivot shaft. When the electrical signal connector is set in an open state, the above-noted electrical signal cable can be extended into the electrical signal connector. In the electrical signal connector, there are many molded materials and corresponding connectors which are used to fix respective leads of the electrical signal cable. These various leads are connected to electrical conductors, and these electrical conductors are further connected to at least one or to several ports within a set of cut-in ports in the electrical signal connector which correspond to the electronic device. After respective leads in the electrical signal cable and electrical conductors in the electrical signal connector have been properly connected, the top portion and bottom portion of the electrical signal connector are rotated on the above-noted pivot shaft, and the two portions of the other side surface opposite the electrical signal connector side surface where the pivot shaft is present are fixed by a screw, so bringing the electrical signal connector to a use state.

When, for whatever reason, it is required to detach the electrical signal cable, it is first necessary to detach the screw and open the top portion and bottom portion of the electrical signal connector by rotating them about the pivot shaft, and then to detach the leads of the electrical signal cable from the internal conductors and so effect separation thereof from these conductors. What is described applies to each lead which is contained in the electrical signal cable, and this also has an outer shield wire layer. When the various leads are fitted and detached, it is also necessary to fit and detach this shield wire layer at the same time. Therefore, a set amount of time is needed for the detachment and fitting processes.

Another problem in existing technology is that a comparatively expensive flexible circuit board has to be used for this type of connector, and, in addition, the connector's internal structure is quite complex, die sinking is needed at the time of manufacture of the outer casing that is used and many internal nonmetallic elements, and so the molding equipment is quite expensive. Because of this, the cost of the connector is quite high.

SUMMARY OF INVENTION

It is therefore an object of the present invention to provide an electrical signal connector whose structure is comparatively simple and the cost of whose manufacture is comparatively low.

According to one aspect of the present invention, the invention provides an electrical signal connector which is interposed between at least one electrical signal cable and an electronic device, each electrical signal cable containing at least one lead, and which is characterized in that it comprises:

an electrical signal cut-in terminal and a first set of cut-in ports and a second set of cut-in ports which are provided on this cut-in terminal, each of the first set of cut-in ports and second set of cut-in ports comprising at least two ports, and each within the at least two ports of the first set of cut-in ports being in correspondence to and maintaining mutual conduction with a port in the second set of cut-in ports; and in which the first set of cut-in ports is connected to input ports or output ports of the above-noted electronic device; and the second set of cut-in ports is conductively connected to leads in the electrical signal cable and to an electrically conductive plate; and the above-noted electrically conductive plate is conductively connected to at least one port in a second set of cut-in terminals and to an outer shield layer of the electrical signal cable.

The above-noted electronic device refers to an electrical signal input device or electrical signal output device.

The above-noted electrical signal cable refers to an electrical signal input or output cable.

Input or output ports connected to the electronic device and the first set of cut-in ports can be the complete set of the input ports or output ports of the electronic device or can be part of the set of the input ports or output ports of the electronic device.

The ports in the electrical signal terminal are electrically conductive ports, and their shape can be round, square or another shape.

The input or output ports of the electronic device can be standard multi-core (or multi-pin) ports, and, therefore, at the time of specific use in electronic equipment, sometimes the electronic device only needs to use some within the various ports, and it is not necessary to use all the ports. Therefore, it is by no means necessary for all these ports to be in communication with the exterior. Similarly, when ports within the first set of cut-in ports in the electrical signal connector which are connected to the electronic device are used in various electronic equipments, there is no need for all these ports to be in a conducting state. What needs to be ensured is that conduction be maintained by that port or those ports in the second set of cut-in ports which is or are connected to at least one projection terminal of the above-noted conductive plate and by ports connected to the electrical signal cable and, likewise, corresponding ports of the first set of cut-in ports.

When the electronic device constitutes an electrical signal input device, a transmitted electrical signal is transferred from the exterior to the electrical signal connector via the electrical signal input cable, goes via a cable clamp, the electrically conductive plate and the electrical signal cut-in terminal and enters the electrical signal input device. When the electronic device constitutes an electrical signal output device, the transmitted electrical signal is output from the electronic device to the electrical signal connector, goes via the electrical signal cut-in terminal, the electrically conductive plate and a cable clamp, and is sent out through the electrical signal output cable.

According to a further aspect of the electrical signal connector of the invention, there is also inclusion of:

at least one cable clamp which is used to restrain the electrical signal cable, this cable clamp being conductively connected to the electrical signal cable's outer shield layer and the electrically conductive plate; and, after being passed through this cable clamp, each lead of the electrical signal cable is inserted in a respective port of the second set of cut-in ports. This cable clamp can be a metal cable clamp.

According to a still further aspect of the electrical signal connector of the invention, the ports in the second set of cut-in ports, which are connected to leads in the electrical signal cable constitute ports which accommodate leads of the electrical signal cable, and ports which are conductively connected in the electrically conductive plate constitute ports which accommodate projection terminals of the electrically conductive plate.

According to another aspect of the electrical signal connector of the invention, the conductive plate has two projection terminals which are respectively matched to the two outermost ports on one side of the electrical signal cut-in terminal. These projections refer to at least one outwardly extending local projection on the conductive plate. This local projection may be a projection made of the same material as the conductive plate, or it may be a projection which is formed with different material on the conductive plate main body by using an inlay, soldering or similar means normally employed in the field.

According to a further aspect of the electrical signal connector of the invention the first set of cut-in ports and the second set of cut-in ports are respectively provided at two side surfaces of the electrical signal cut-in terminal. They can preferably be provided on two opposite side surfaces thereof.

According to a further aspect of the electrical signal connector of the invention, a cable clamp can be used to effect local bundling of at least one electrical signal cable and the conductive plate together; alternatively, a cable clamp and at least one electrical signal cable can be used to effect bonding together with the conductive plate.

According to a further aspect of the electrical signal connector of the invention, a sleeve of insulating material is used to cover, in a slidable manner, the end of the electrical signal cable, the conductive plate and that set of ports, in the electrical signal cut-in terminal, which is connected to the conductive plate and leads of the electrical signal cable.

According to another aspect of the invention, the conductive plate has, at one side, two projecting ports which match corresponding ports on one side of facing electronic equipment at the back of the electrical signal cut-in terminal. Another arrangement which can be adopted is one in which the two projecting ports respectively match the two outermost ports on one side of facing electronic equipment at the back of the electrical signal cut-in terminal. This arrangement can effect more stable connection between the cut-in terminal and the electronic equipment.

The conductive plate can be prepared by procedure which is normally employed in the field, and, for example, it is produced by pressing a metal plate or metal piece or by casting and trimming electrically conductive metal. The projections carried by the conductive plate may be the same material as the other part of the conductive plate and be formed by a one-time forming procedure at the time of production of the conductive plate, or they may be material which is different from that of the other part of the conductive plate and be formed on this other part by means of riveting or soldering, etc.

When the electrical signal connector is connected to electronic equipment, the procedure can be that, first, an external electrical signal cable is passed through the cable clamp, and then this cable is firmly bonded to one side surface of the conductive plate, so bringing the cable's connectors and the conductive plate's terminals together, and insertion into corresponding ports on the other side of the electrical signal cut-in terminal is effected.

According to another aspect of the invention, one or two or more cable clamps can be used. A cable clamp can be used to fix an electrical signal cable and a conductive plate together (eg, by locally bundling the electrical signal cable and conductive plate together by means of a ring clamp), and it is also possible to bond the electrical signal cable and conductive plate together locally by means of screws or rivets.

According to a further aspect of the invention, a sleeve for which insulating material is used can be provided in a slidable manner on the cable and be used to cover the electrical signal cable's terminals, the conductive plate and electrical signal terminal ports which are connected to the conductive plate. For example, a sleeve which is made using an insulating manner can retractably cover the end of the electrical signal cable, the conductive plate and the set of input/output ports of the electrical signal cut-in terminal which are connected to the conductive plate and leads of the electrical signal cable, in order to reinforce the device's insulation performance and improve the stability of the device operation.

The electrical signal connector of the invention uses two sets of internal electrically conductive cut-in ports, and therefore offers the advantages that there is no need to use a flexible circuit board as a conducting element, nor is there any need to provide a molded outer casing, the connections are fast and reliable, and the cost is comparatively low.

BRIEF DESCRIPTION OF THE DRAWINGS

FIG. 6 is a disassembly drawing of the structure of this electrical signal connector; and FIG. 7 shows the state after installation of this electrical signal connector.

DETAILED DESCRIPTION OF INVENTION

Figure 1:
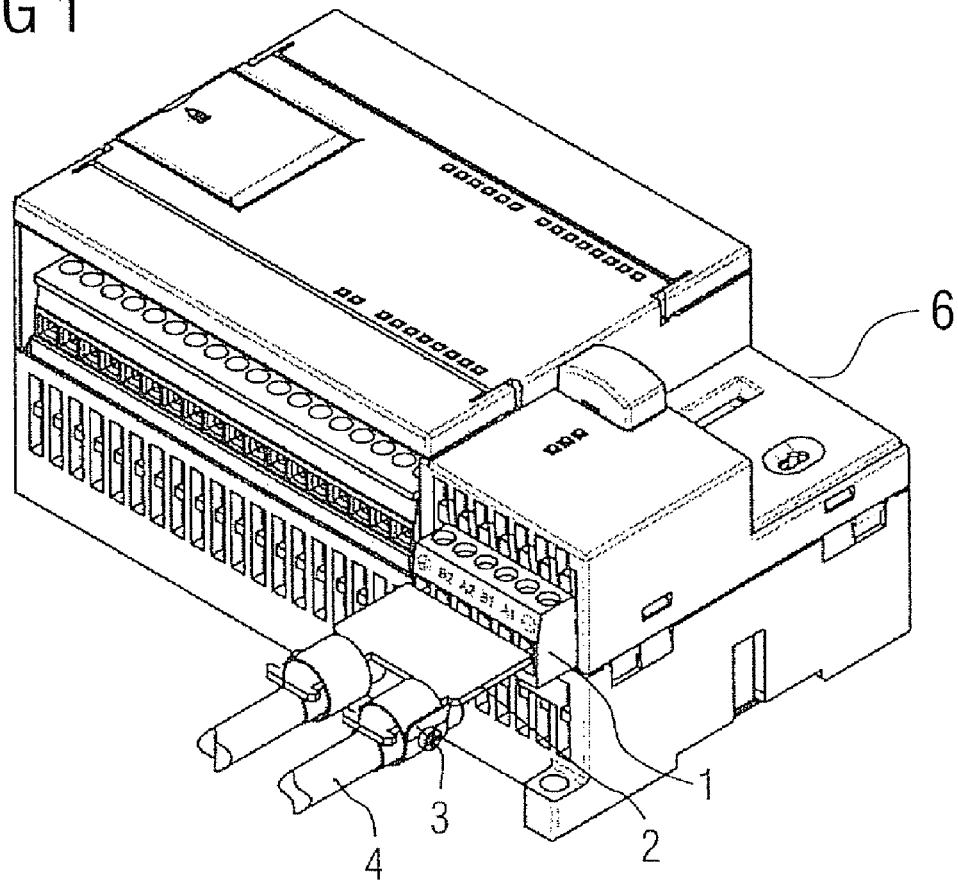
FIG. 1 schematically shows an electrical signal connector of the invention fitted to a related electrical signal output device.
Figure 2:
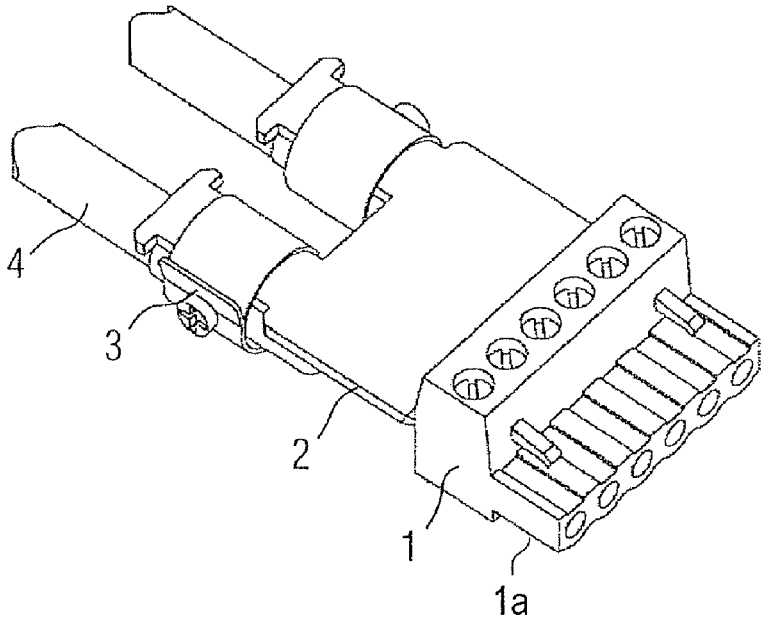
FIG. 2 is an overall side perspective view of the electrical signal connector shown in FIG. 1.
Figure 3:
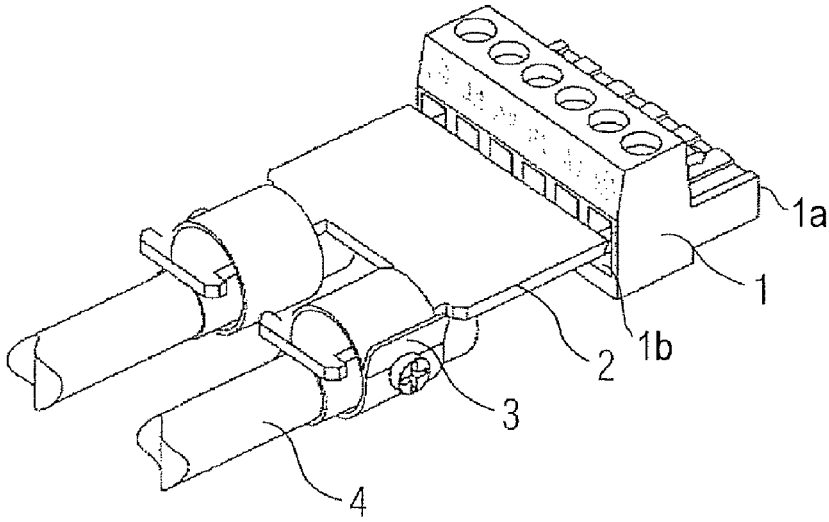
FIG. 3 is an overall side perspective view from another direction of the electrical signal connector shown in FIG. 1.
Figure 4:
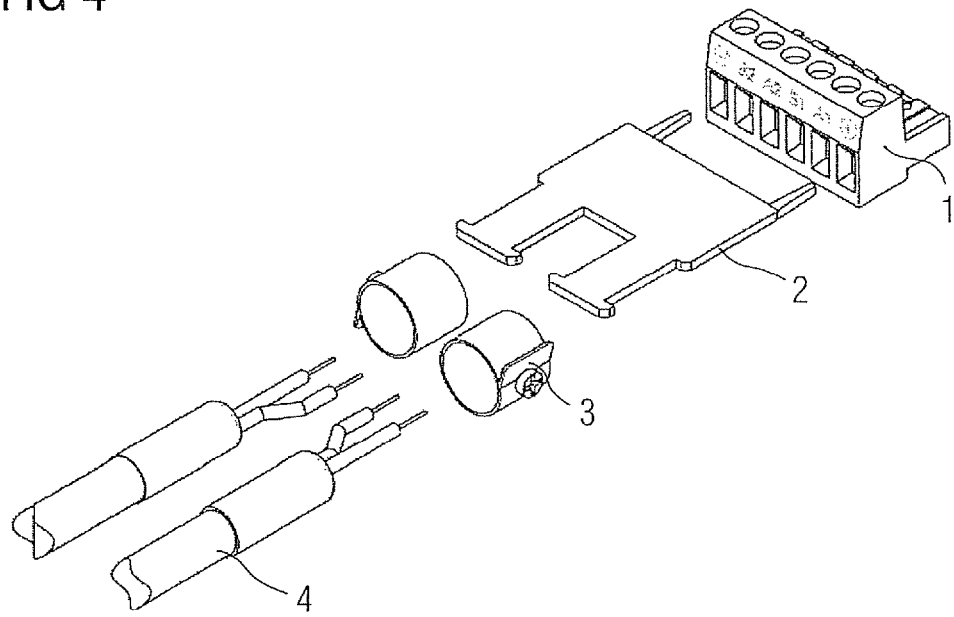
FIG. 4 is a disassembly drawing of the structure of the electrical signal connector shown in FIG. 1.

FIG. 1 through FIG. 4 show one specific example of implementation of the electrical signal connector of the invention which serves to output the signals of an electronic device to an electrical signal output cable and send them out via this cable. In these drawings, FIG. 1 schematically shows an electrical signal connector of the invention fitted to a related electrical signal output device, FIG. 2 is an overall side perspective view of this electrical signal connector, FIG. 3 is an overall side perspective view from another direction, and FIG. 4 is a disassembly drawing of the electrical signal connector.

In FIGS. 1 through 4, reference number 1 indicates an electrical signal cut-in terminal, 2 indicates an electrically conductive plate, 3 indicates a cable clamp, 4 indicates an electrical signal output cable, and 6 indicates an electronic device. The electrical signal cut-in terminal 1 comprises a first cut-in terminal set 1*a* and a second cut-in terminal set 1*b*. In this example of implementation, the first cut-in terminal set 1*a* and the second cut-in terminal set 1*b* each have 6 ports. Within these, the six ports of the first cut-in terminal set 1*a* are connected to six output ports of the electronic device. Within the six ports of the second cut-in terminal set 1*b*, the two outermost ports serve to accommodate two projecting terminals of the conductive plate, and the middle 4 ports serve to accommodate 4 leads of an electrical signal output cable which communicates with the exterior. There are respective fixture heads above the 6 ports of the second cut-in terminal set 1*b*, and, after the projecting terminals of the conductive plate 2 and lead connectors have been extended into these terminals, they are fixed together with the ports by means such as screws, etc. When the screws are loosened, the projecting terminals of the conductive plate 2 and the lead connectors can be separated from the terminals. The conductive plate 2 is matched to the output ports of the above-noted electrical signal output device. In this example of implementation, the electrical signal connector 1 has two cable clamps 3 (it being of course possible for the number of cable clamps to be one or three or more in other examples of implementation). In the use state, each of the cable clamps 3 has one surface conductively connected to a local portion of the conductive plate 2 and the other surface conductively connected to the outer shield layer of one electrical signal output cable 4. Each cable in a pair of electrical signal output cables 4 has two leads inside. Electrical signals are ultimately fed out to the exterior from these electrical signal output cables 4.

FIG. 1 shows the electrical signal connector and electronic device connection state. When it is required to replace the electrical signal connector, the procedure can be that first the electrical signal connector together with the entirety of the cables is pulled out from the electrical signal output device, the 6 upper fixture screws in the electrical signal cut-in terminal 1 are unscrewed, the conductive plate 2, cable clamps 3 and electrical signal output cables 4 are disassembled from the electrical signal cut-in terminal 1, and the damaged electrical signal cut-in terminal 1 or conductive plate 2 or a damaged cable clamp 3 or electrical signal output cable 4 is removed and replaced by a corresponding new element. The procedure at the time of connector installation can be that first the electrical signal output cables 4 and conductive plate 2 are arranged in order, so bringing the 4 connectors of the electrical signal output cables 4 into positional correspondence with the two connectors of the conductive plate and the 6 ports of the electrical signal cut-in terminal 1, and then they are securely fixed to the electrical signal cut-in terminal 1 by screws. After that, the conductive plate 2 and the electrical signal output cables 4 are fixed together by means of the cable clamps 3. Finally, going from the port on the right-hand side, the electrical signal cut-in terminal 1 is inserted in the output ports of an electrical signal output device, and electrical signal input or output is effected.

Figure 5:
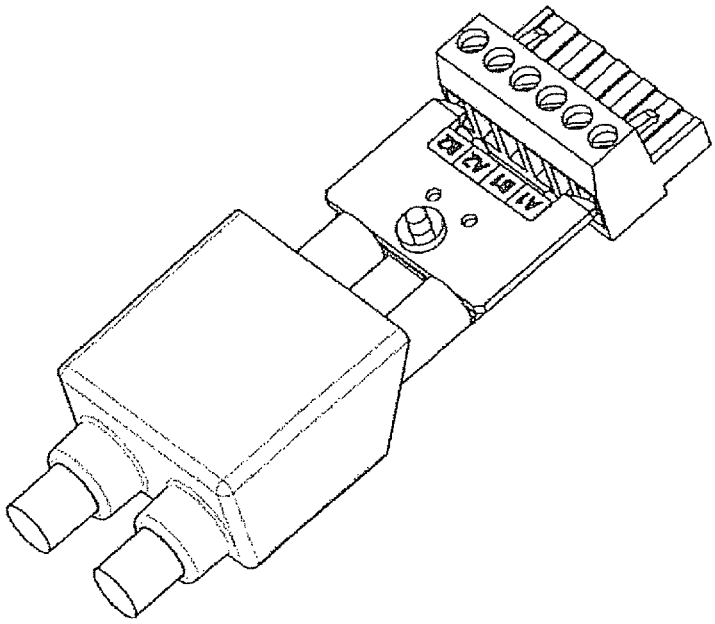
FIG. 5 through FIG. 7 are drawings showing another example of the electrical signal connector of the invention in which FIG. 5 schematically shows a state in which this electrical signal connector is set in an assembly.
Figure 6:
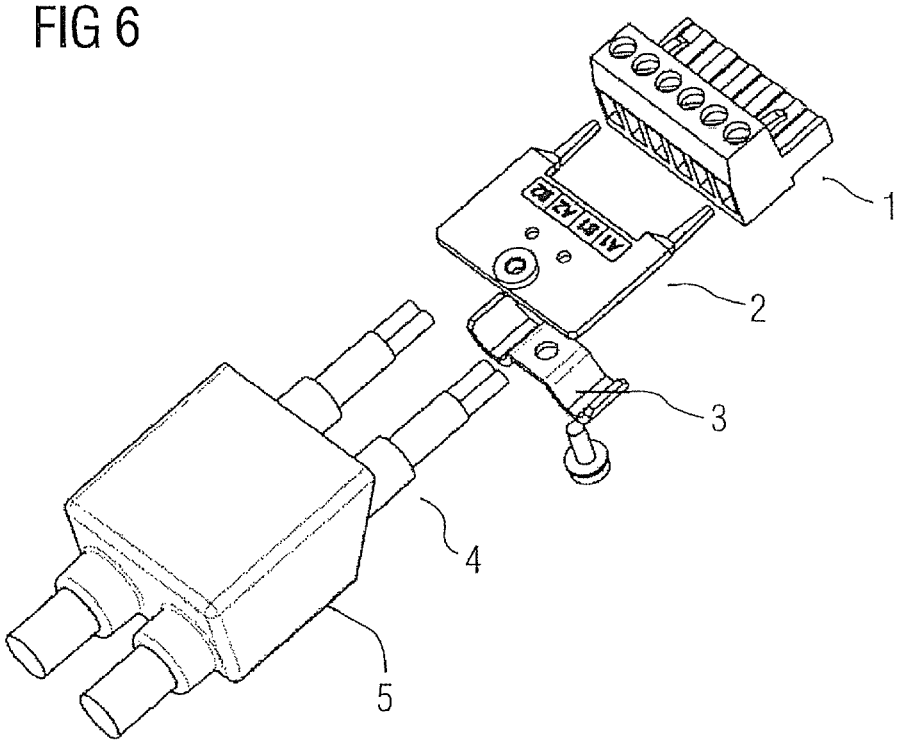
Figure 7:
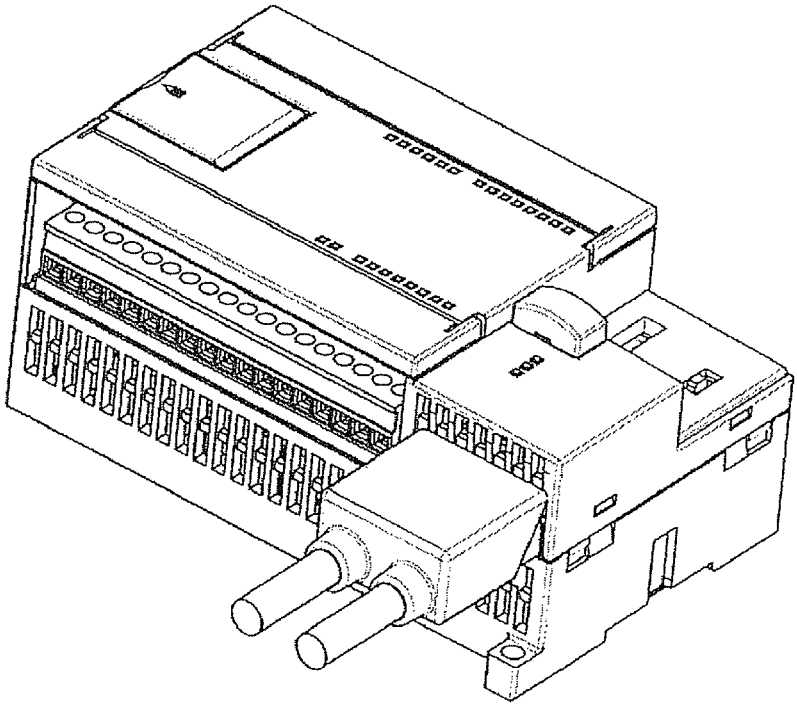

FIG. 5 through FIG. 7 show another example of the electrical signal connector of the invention. As shown in FIG. 5, the difference from the example shown in FIGS. 1 through 4 is that, whereas the former example of implementation used two cable clamps, each of which fixes one cable within two electrical signal output cables 4, this example of implementation uses only one cable clamp to fix two electrical signal output cables 4 to a conductive plate 2. As can be seen from FIG. 6, through-holes are provided in the central portion of the cable clamp 3, and two electrical signal cables 4 gripped in the cable clamp 3 are fixed on the conductive plate 2 by means of a set of screws and nuts. The conductive plate itself carries nuts in this example.

Apart from that, in this example of implementation, a sleeve 5 constituted by a layer of insulating material is used to cover the ends of the electrical signal output cables 4, the conductive plate 2 and all the ports of the electrical signal cut-in terminal 1. This layer 5 of non-conducting material can, for example, be a layer of insulating plastic. FIG. 7 schematically shows the state when the electrical signal connector of this example of implementation is connected together with an electrical signal output device. As can be seen from FIGS. 5 through 7, the layer 5 of non-conducting material goes from the direction of the electrical signal output cables 4 towards the electrical signal output device direction, and is ultimately fitted on the electrical signal connector of the invention and faces the ports of one terminal of the conductive plate 2. By the same logic, the layer 5 of non-conducting material can go in the opposite direction, from the installed device towards the electrical signal output cables 4, and be removed. As well as imparting a better reference potential and antistatic performance to the equipment, the sleeve 5 of insulating material also improves the appearance of the overall equipment.

What is presented by the described content of FIG. 1 through FIG. 7 is one electrical signal output connection device of the invention. In practice, it is also possible to input electrical signals by means of the same connection device, and this depends on the use to which the connection device of the invention is put. Therefore, the electrical signal connection device of the invention can be widely employed in electrical signal input and output equipment.

Since the device of the invention does not use a large number of molded elements possessing a complex structure, the cost of its manufacture is comparatively low. In addition, since the device's structure is simple, it is easy to connect it rapidly to electrical signal output equipment.

The invention claimed is:

1. An electrical signal connector which is interposed between an electrical signal cable and an electronic device, comprising:

an electrical signal terminal;

a first port set;

a second port set;

an electrically conductive plate, wherein the first port set and the second port set are provided on said electrical signal terminal, wherein said first port set and second port set each comprise two ports, wherein each port of said first port set maintains correspondence and mutual conduction with one port in said second port set;

wherein said first port set is connected to output ports of said electronic device;

wherein said second port set is conductively connected to leads in said electrical signal connector cable; and wherein the electrically conductive plate is conductively connected to at least one port in said second terminal set and to an outer shield layer of said electrical signal cable; and a sleeve, which is used as insulating material, placed in a slidable manner on said electrical signal cable and servers to cover an end of said electrical signal cable, said conductive plate, and ports of said electrical signal terminal which are connected to said conductive plate.

2. The electrical signal connector as claimed in claim 1, wherein said first port set and second port set are disposed on opposite side surfaces of said electrical signal cut in terminal.

3. The electrical signal connector as claimed in claim 1, further comprising:

a cable clamp which is used to restrain said electrical signal cable, wherein said cable clamp is conductively connected to said outer shield layer of said electrical signal cable and to said conductive plate, and and wherein each lead in said electrical signal cable is passed through said cable clamp and then being inserted into one port of said second port set.

4. The electrical signal connector as claimed in claim 3, wherein ports in said second port set, which are connected to leads of said electrical signal cable, are ports which accommodate the leads of said electrical signal cable, and wherein ports, which are conductively connected to said conductive plate, are ports which accommodate projecting terminals of said conductive plate.

5. The electrical signal connector as claimed in claim 4, wherein said conductive plate has two projecting terminals which are matched to two outermost ports on one side of said electrical signal terminal.

6. The electrical signal connector as claimed in claim 3, wherein the cable clamp fixes at least one further cable on said conductive plate.

7. The electrical signal connector as claimed in claim 6, wherein the cable clamp and the at least one further cable are bonded together with said conductive plate by screws or rivets.

* * * * *